United States Patent [19]

Ebner et al.

[11] 4,051,486

[45] Sept. 27, 1977

[54] DIGITAL FLASH INTENSITY CONTROL SYSTEM FOR PHOTOTYPESETTERS

[75] Inventors: Peter R. Ebner, South Nashua; Louis E. Griffith, Hampstead, both of N.H.

[73] Assignee: Itek Corporation, Lexington, Mass.

[21] Appl. No.: 628,692

[22] Filed: Nov. 3, 1975

[51] Int. Cl.[2] ..... B41B 13/00

[52] U.S. Cl. ..... 354/7

[58] Field of Search ..... 354/4, 5, 7; 355/67, 355/69; 315/241 P

[56] References Cited

U.S. PATENT DOCUMENTS

| | | | |
|---|---|---|---|
| 3,710,698 | 1/1973 | Sinnott et al. | 354/7 |
| 3,738,242 | 6/1973 | Lee et al. | 354/4 |
| 3,909,832 | 9/1975 | Booth | 354/5 |

*Primary Examiner*—L. T. Hix

*Assistant Examiner*—Alan Mathews

*Attorney, Agent, or Firm*—Homer O. Blair; Robert L. Nathans; Gerald H. Glanzman

[57] ABSTRACT

For variable letter sizes being photographically recorded in a second generation phototypesetter, it is desired to increase generated quantities of light flux produced by the flash lamp operating in conjunction with a font disc where larger letter sizes are thereby imaged upon the photosensitive medium, and conversely, to reduce such flux where smaller characters are to be projected. The disclosed system employs a digital letter size code for controlling the amount of charge inserted into a storage capacitor via a digital to analog converter and multivibrator. When the flash lamp is triggered at the appropriate time to selectively illuminate a given character, the energy associated with the stored charge is employed to energize the lamp.

8 Claims, 2 Drawing Figures

DIGITAL FLASH INTENSITY CONTROL SYSTEM FOR PHOTOTYPESETTERS

BACKGROUND OF THE INVENTION

This invention relates to the field of phototypesetting machines.

In so-called second generation phototypesetting machines, characters formed upon a moving character disc or drum are selectively illuminated in order to "flash" the desired characters which in turn causes images of the characters photographically formed upon the font disc, to be projected upon a photosensitive receptor sheet as is well understood by those skilled in the art. Where multiple character sizes are to be formed upon the photosensitive receptor sheet, it is highly desirable to increase the light flux for larger character sizes and to decrease the flux for smaller ones in order not to over or under expose the photosensitive receptor sheet. Generally, such compensation is effected by placing filters over the projection lenses, or in the alternative, by mechanically adjusting the diameter of an "*f*" stop. These methods are costly and unreliable.

SUMMARY OF THE INVENTION

In accordance with a preferred embodiment of the present invention, the above-mentioned filters or "*f*" stops are eliminated by increasing a stored electrical charge energizing the flash lamp for larger letter size codes to produce a greater quantity of light flux, and conversely by decreasing such charge to reduce such flux for smaller letter sizes to be projected upon the receptor sheet. In the most preferred embodiment, binary letter size codes control the amplitude of a square wave pulse train oscillator produced by an oscillator, which in turn controls the quantity of the applied flash lamp energizing charge.

Other objects, features, and advantages of the present invention will become apparent upon the perusal of the following detailed description taken in conjunction with the figures in which:

FIG. 1 discloses a preferred embodiment of the light flux control system, and

FIG. 2 discloses one type of means for selectively inserting various letter size codes into the register shown in FIG. 1.

DETAILED DESCRIPTION

Figure 1:
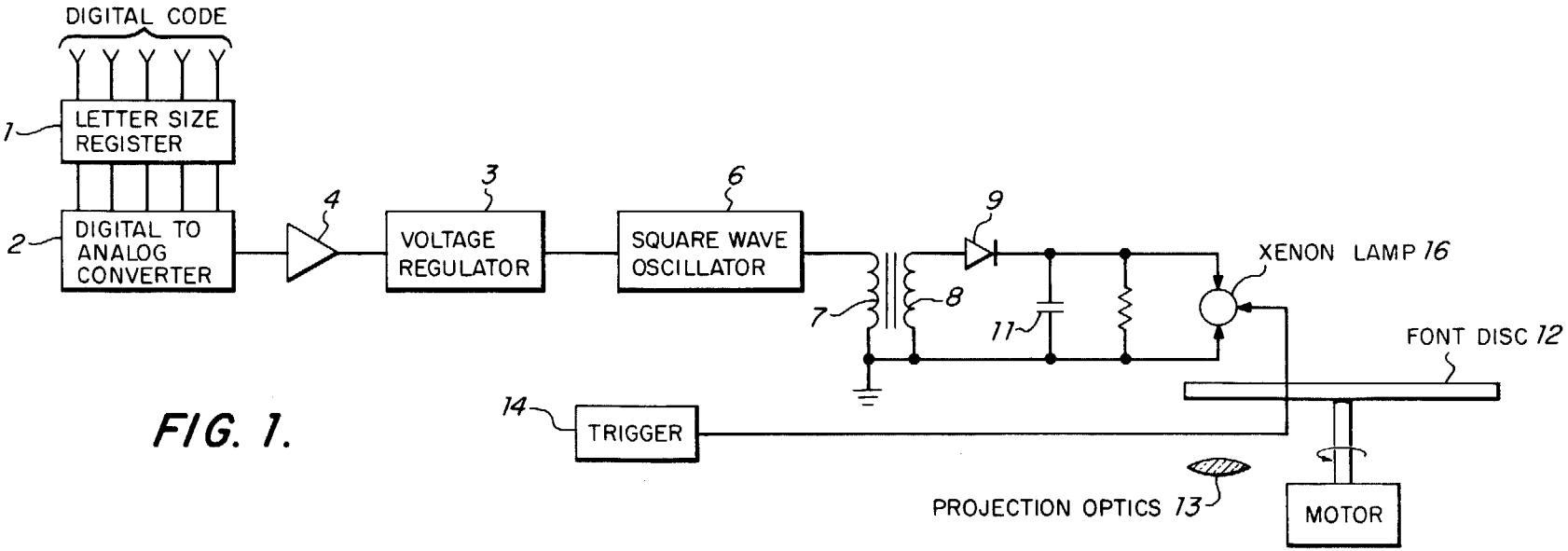

A letter size code register 1 is disclosed for storing a binary letter size code which controls the appropriate amount of exposure light flux for a particular letter size. These letter size codes are ascertained during calibration of the phototypesetters during manufacturing. A digital to analog converter 2 is coupled to voltage regulator 3 via amplifier 4. The output circuit of the voltage regulator will produce a voltage proportional to the value of the code in register 1 indicative of a desired letter size. Oscillator 6 generates a square wave having an amplitude proportional to the voltage produced at the output circuit of regulator 3. The output of oscillator 6 is applied to the primary winding 7 of the step-up transformer illustrated, thereby to produce a higher voltage across secondary winding 8 which passes through diode 9 to thereby charge storage capacitor 11. Diode 9 prevents discharge of capacitor 11 through winding 8. When the desired character on font disc 12 is properly positioned with respect to the optical axis associated with projection optics 13, trigger circuit 14 associated with conventional means not shown, will cause the charge in capacitor 11 to energize xenon lamp 16, to thereby project the optical image of the selected character upon the photosensitive receptor sheet.

Now let it be assumed that the character size is to be increased. An appropriate adjustment is made in the position of the elements of the projection optics to maintain focus as is well understood. Since it is desirable to increase the light flux or flashing energy of lamp 6 to maintain the degree of exposure constant for the larger character to be projected upon the photosensitive receptor sheet, the command for effecting the character size increase will cause register 1 to be cleared, and will cause a new code of a higher value to be inserted into the register. This action increases the amplitude of the digital to analog converter output and in turn the amplitude of the output of oscillator 6 to increase the charge inserted into capacitor 11, which in turn increases the lamp energization, thereby to maintain the image density of the larger characters constant. Conversely, reducing the value of the letter size codes for smaller letters reduces the generated light flux.

Figure 2:
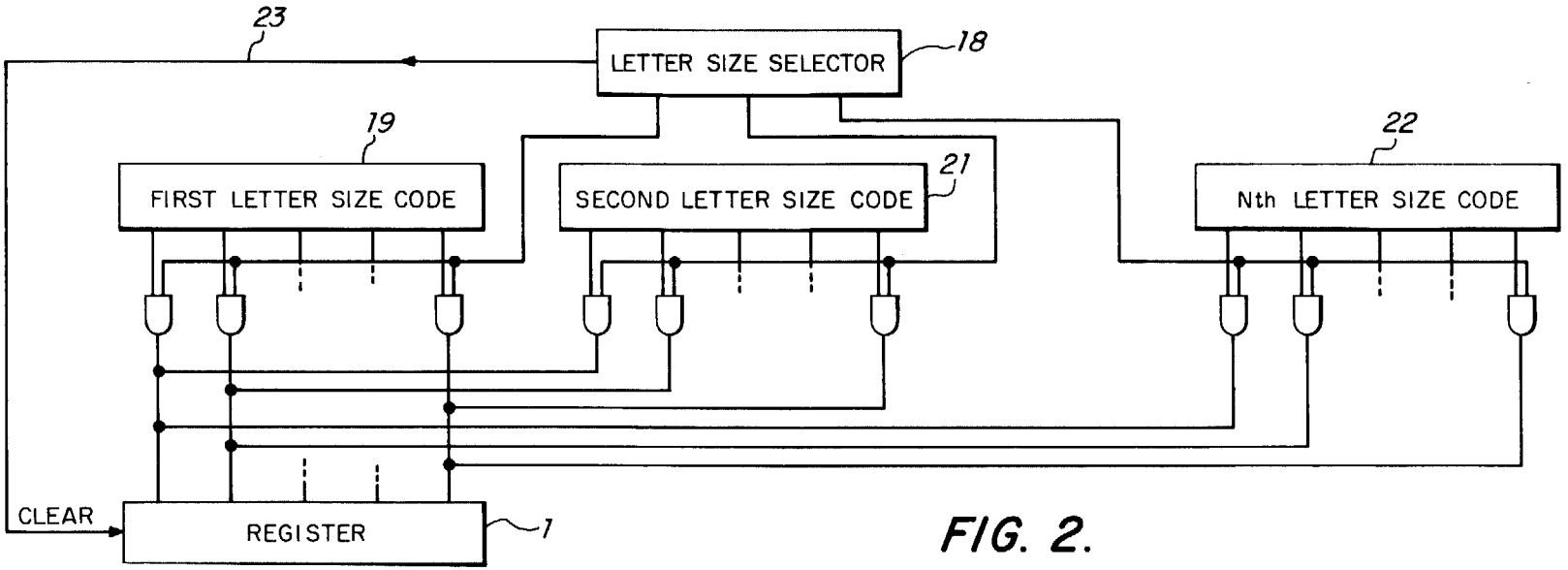

FIG. 2 illustrates one of many possible arrangements for changing the letter size codes within register 1. A program device 18 causes a desired letter size code stored within memories 19, 21, and 22 to be selectively inserted into register 1 by enabling a particular bank of the banks of AND gates illustrated. Before a new code is inserted ito the register through AND gates, the programing device 18 generates a pulse on conductor 23 which clears register 1.

It should thus be appreciated that the relatively cumbersome, costly, and unreliable prior art methods for changing the exposure intensity with changes in letter size have been eliminated in favor of the above-mentioned teachings.

Obviously, numerous variations of the above-mentioned electronic system may be made within the scope of the present invention. For example, the output of the digital to analog converter may be employed to change the duty cycle of a fixed length plural pulse train which may be gated across primary winding 7 of the step-up transformer. Other pulse generators such as one shot multivibrators or fixed length pulse train generators could be employed wherein the voltage regulator controls duty cycle, pulse widths, amplitudes, etc.

While preferred embodiments of the invention have been described, the teachings of this invention will readily suggest many other embodiments to those skilled in the art.

What is claimed is:

1. In a phototypesetter:

a. a font storage medium;

b. a light generator for momentarily illuminating selected characters of said font storage medium;

c. a letter size control means for producing a code related to the desired letter size to be typeset; and d. light flux generator control means coupled between said letter size control means and said light flux generator for applying a variable flux control signal to said light flux generator proportional to the code produced by said letter size control circuit, said light flux generator control means including an electrical charge generator for producing an electrical charge proportional to the code produced by said letter size control means for controlling the degree of light flux generated by said light flux generator, said charge generator further including an electrical pulse generator for producing an output having energy proportional to said code produced by said letter size control means, together with a storage capacitor coupled to said electrical pulse generator for storing a charge therein proportional to said energy of the output produced by said electrical pulse generator.

2. The phototypesetter as set forth in claim 1 wherein said light flux generator control means includes a digital to analog converter coupled to the output circuit of said letter size control means for producing an analog signal having an amplitude proportional to said code produced by said letter size control means, together with an oscillator coupled to the output circuit of said digital to analog converter wherein the energy of the output of said oscillator is proportional to the amplitude of the output signal of said digital to analog converter, and a trigger means for effecting the discharge of the charge within said storage capacitor into said light flux generator.

3. In a phototypesetter:

a. a font storage medium;

b. an xenon flash lamp for momentarily illuminating selected characters of said font storage medium;

c. a letter size control means for producing a code related to the desired letter size to be typeset; and d. light flux generator control means coupled between said letter size control means and said xenon flash lamp for applying a variable flux control signal to said xenon flash lamp proportional to the code produced by said letter size control circuit, said light flux generator control means further comprising a charge generator including an electrical oscillator for producing an output having energy proportional to said code produced by said letter size control means together with a storage capacitor coupled to said electrical oscillator for storing a charge therein proportional to said energy of the output pulses produced by said electrical oscillator.

4. The phototypesetter as set forth in clam 3 wherein said light flux generator control means includes a digital to analog converter coupled to the output circuit of said letter size control means for producing an analog signal having an amplitude proportional to said code produced by said letter size control means, together with means for coupling said oscillator to the output circuit of said digital to analog converter wherein the energy of the output of said oscillator is proportional to the amplitude of the output signal of said digital to analog converter, and a trigger means for effecting the discharge of the charge within said storage capacitor into said xenon flash tube.

5. In a phototypesetter:

a. a font storage medium;

b. a light flux generator for momentarily illuminating selected characters of said font storage medium;

c. a register for containing a code proportional to the letter size to be typeset;

d. a digital to analog converter having an input circuit coupled to the output circuit of said register for generating an analog signal porportional to the code stored in said register;

e. a voltage regulator having an input circuit coupled to the output circuit of said digital to analog converter;

f. an oscillator having an input circuit coupled to the output circuit of said voltage regulator for producing an output having an amplitude proportional to the amplitude of the output voltage of said voltage regulator;

g. a storage capacitor coupled to the output circuit of said oscillator for storing a charge therein proportional to the amplitude of the output produced by said oscillator; and h. trigger means for causing the charge stored in said storage capacitor to activate said light flux generator, thereby to illuminate a selected character associated with said font storage means.

6. The combination as set forth in claim 5 further including a voltage step-up transformer coupled between said oscillator and said storage capacitor.

7. The combination as set forth in claim 5 wherein said light flux generator comprises a xenon flash lamp.

8. The combination as set forth in claim 6 wherein said light flux generator comprises a xenon flash lamp.

* * * * *